US008118025B2

(12) United States Patent
Becker et al.

(10) Patent No.: US 8,118,025 B2
(45) Date of Patent: Feb. 21, 2012

(54) BLOW FILTER DEVICE

(75) Inventors: Frank Becker, Berlin (DE); Detlef Kielow, Berlin (DE); Martin Weber, Berlin (DE); Michael Schulz, Teltow (DE)

(73) Assignee: MSA Auer GmbH, Berlin (DE)

( * ) Notice: Subject to any disclaimer, the term of this patent is extended or adjusted under 35 U.S.C. 154(b) by 997 days.

(21) Appl. No.: 10/592,424

(22) PCT Filed: Jan. 27, 2005

(86) PCT No.: PCT/DE2005/000152

§ 371 (c)(1),
(2), (4) Date: Aug. 21, 2007

(87) PCT Pub. No.: WO2005/087319

PCT Pub. Date: Sep. 22, 2005

(65) Prior Publication Data

US 2008/0127979 A1 Jun. 5, 2008

(30) Foreign Application Priority Data

Mar. 11, 2004 (DE) ..... 10 2004 013 453

(51) Int. Cl.
*A62B 7/10* (2006.01)

(52) U.S. Cl. ..... 128/205.12; 128/201.22; 128/201.25; 128/204.21; 128/205.25; 128/205.27

(58) Field of Classification Search ..... 128/204.21, 128/204.22, 204.23, 204.18, 201.22, 201.23, 128/201.25, 202.22, 205.12, 205.25, 205.27, 128/205.29, 206.12, 206.21
See application file for complete search history.

(56) References Cited

U.S. PATENT DOCUMENTS 3,200,316 A * 8/1965 Engel ..... 433/131
(Continued)

FOREIGN PATENT DOCUMENTS

DE 19502360 3/1996
(Continued)

OTHER PUBLICATIONS

International Search Report mailed Jul. 26, 2005 in corresponding International application PCT/DE2005/000152.
(Continued)

*Primary Examiner* — Justine Yu
*Assistant Examiner* — LaToya M Louis
(74) *Attorney, Agent, or Firm* — Davidson Berquist Jackson & Gowdey, LLP

(57) ABSTRACT

A blow filter device for breathing masks and hoods, comprising a blower which is driven by a motor and at least one filter which is arranged upstream from the blower, in addition to an electronic control system for adjusting a predefined airflow volume. The invention is characterized in that the motor is an electronically commutated direct current motor (6) which is controlled with the aid of a pulse width modulation ratio as a control variable, wherein a calibrating curve is created and stored in the memory (14) of the electronic control system and is based on a plurality of different filter resistances and a respectively corresponding pulse-width modulation ratio (PWM) and the respective motor speed (n) for a specific volume of air. The direct current motor can be controlled in the hood mode according to the speed (n) measured in relation to the respective filter resistance after activation with the aid of the associated pulse-width modulation ratio read from the calibrating curve and can be controlled in the mask mode independently of the respective filter resistance with a respective specific constant pulse-width modulation ratio (PWM) for the associated mask type, wherein the electronic control system (5) is associated with an identifying means (19,20) which is used to recognize the associated head part and to adjust the operational mode concerned.

12 Claims, 1 Drawing Sheet

U.S. PATENT DOCUMENTS

| | | | | |
|---|---|---|---|---|
| 4,513,233 | A | 4/1985 | Giammarrusco et al. | |
| 4,905,687 | A | 3/1990 | Ponkala et al. | |
| 5,303,701 | A * | 4/1994 | Heins et al. | 128/206.17 |
| 5,318,018 | A * | 6/1994 | Puma et al. | 128/202.11 |
| 5,318,020 | A | 6/1994 | Schegerin et al. | |
| 5,394,870 | A * | 3/1995 | Johansson | 128/205.22 |
| 5,413,097 | A * | 5/1995 | Birenheide et al. | 128/206.17 |
| 5,577,496 | A * | 11/1996 | Blackwood et al. | 128/201.25 |
| 5,671,730 | A * | 9/1997 | Ollila | 128/204.21 |
| 6,360,741 | B2 * | 3/2002 | Truschel | 128/202.22 |
| 6,575,165 | B1 * | 6/2003 | Cook et al. | 128/206.17 |
| 6,591,834 | B1 * | 7/2003 | Colla et al. | 128/204.21 |
| 6,873,072 | B2 * | 3/2005 | Ganter et al. | 310/68 R |
| 6,992,418 | B2 * | 1/2006 | Hans | 310/216.091 |
| 7,438,073 | B2 * | 10/2008 | Delache et al. | 128/204.23 |
| 2002/0062830 | A1 | 5/2002 | Meier et al. | |
| 2003/0019494 | A1 | 1/2003 | Bennett et al. | |
| 2006/0191533 | A1 * | 8/2006 | Brookman et al. | 128/201.25 |

FOREIGN PATENT DOCUMENTS

| | | |
|---|---|---|
| EP | 0352938 | 1/1990 |
| EP | 0621056 | 10/1994 |
| WO | WO 02/11815 | 2/2002 |
| WO | WO 02/23298 | 3/2002 |

OTHER PUBLICATIONS

International Preliminary Examination Report Including Written Opinion mailed Oct. 12, 2006 in corresponding International Applicaiton PCT/DE2005/000152.

* cited by examiner

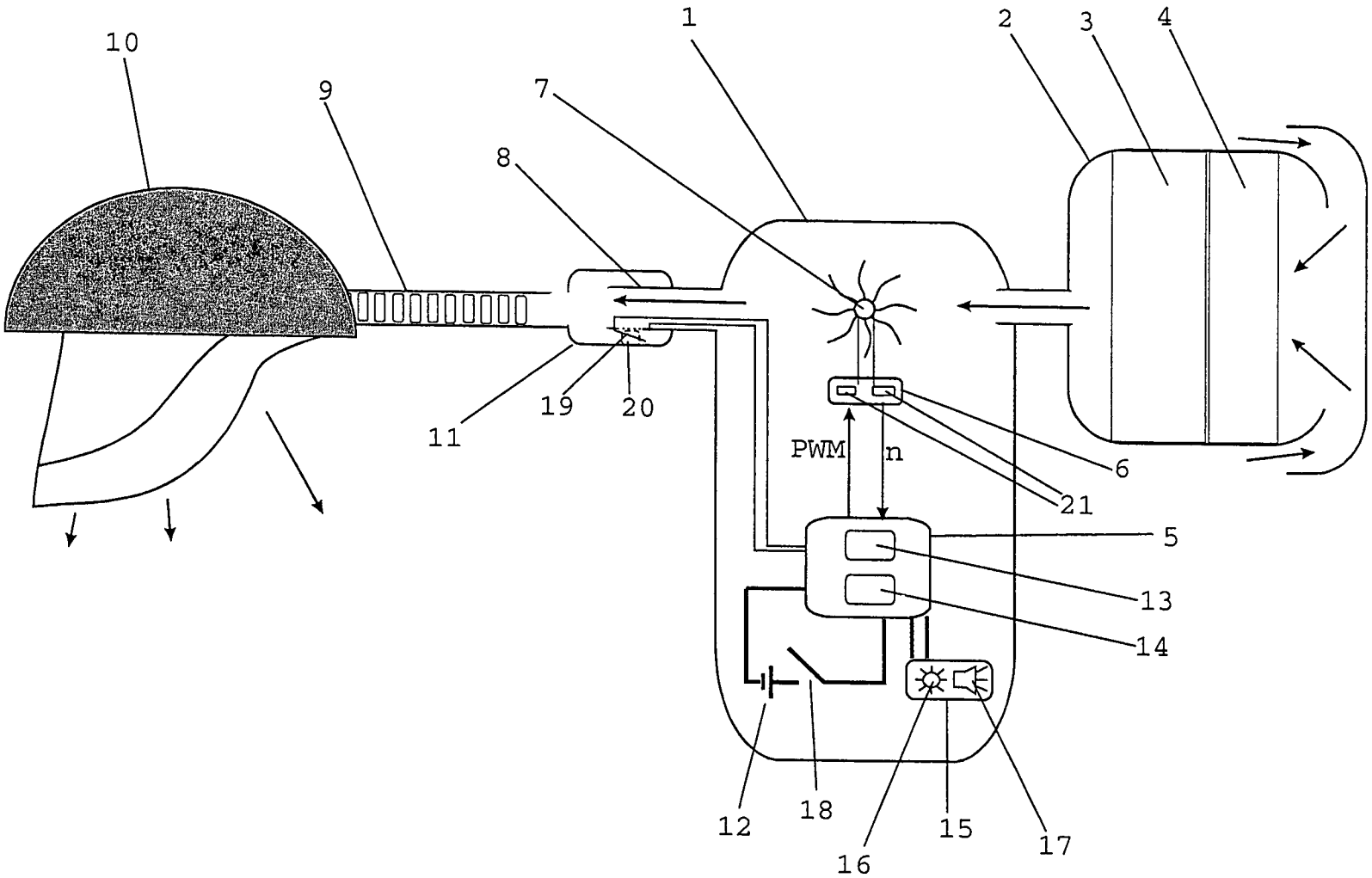
1
2
3
4
5
6
7
8
9
10
11
12
13
14
15
16
17
18
19
20
21
n
PWM

BLOW FILTER DEVICE

The invention relates to a blow filter device for breathing masks and hoods comprising a blower which is driven by a motor and at least one filter which is arranged upstream from the blower as well as an electronic control system associated to the motor for adjusting a predefined airflow volume.

Blow filter devices for breathing masks and hoods are used to provide the wearer of the hood or mask with filtered respiratory air by means of a blower in an environment that is contaminated by gases and particles. The known apparatuses use a blower that transports air through a filter via a hose into the hood or mask. The operating conditions of these devices change during their use, for example due to filter contamination. This requires adjustment of the blower speed to keep the volumetric flow of the respiratory air in the mask or hood constant. Various arrangements are known for adjusting the volumetric flow.

EP 0352938 A2 uses an arrangement of two pressure sensors, one of which upstream and one downstream from the blower, to measure the differential pressure and use it to control the blower speed.

EP 0621056 A1 proposes to measure the back pressure downstream from the blow filter device, the back pressure caused by the flow resistance of the hood being used as a measure for the airflow volume.

These solutions have setbacks in that the use of pressure sensors takes a fairly great design and equipment effort and is very costly in the long run.

DE 19502360 A1 describes a solution in which the output of the blower is controlled by measuring the operating current and rotational speed of the motor. WO 02/23298 A1 uses a similar method in which the rotational speed is controlled based on the energy consumption of the motor, i.e. the motor output has to be continuously readjusted by costly voltage and current correction depending on the resistance change of the filters.

WO 02/11815A1 describes another way of controlling the airflow volume. In this arrangement, the blower speed is set using the motor output of a direct current motor. The motor output is set in such a way that the required volumetric flow is achieved even with the most sluggish filters. The method requires monthly calibration without a filter and manual recalibration for each filter used. The known flow resistance of an airflow indicator attached to the blow filter device instead of the hood can be used to determine the blower speed required for a specific airflow volume. The disadvantage of this method is that a recalibration is required when conditions change. The user must disconnect the blow filter device from the hood and connect the airflow indicator. Smooth running filters require manual tuning. In addition, the device cannot be operated with a mask.

It is therefore the object of this invention to provide a blow filter device for breathing masks and hoods that is simple and cost efficient and allows practicable use.

This objective is achieved according to the invention by the blow filer device as described herein along with other useful improvements and embodiments of the invention.

The inventive idea in a blow filter device of the type mentioned at the outset consists in the use of an electronically commutated direct current motor associated with the blower and controlled by the electronic control system using a pulse width modulation ratio as a control variable to generate a specific motor speed and a respective airflow volume, for hood operation mode, using a pulse width modulation ratio read from a calibration curve stored in the electronic control system and reflecting the relationship among filter resistance values, motor speeds, and air volumes according to the respective input resistance based on the speed measured during startup in a calibration mode, and, in mask operation, using a constant pulse width modulation ratio according to the respective mask type used and stored in the electronic control system, said electronic control system detecting the respective hood or mask type (hereinafter: head part) by means of a sensing and control system associated with the fitting between the breathing mask or hood and the blow filter device and automatically setting the respective control mode.

During the calibration process performed after switching the device on in hood operation mode, the direct current motor is triggered by a specific value of the pulse width modulation ratio and the resulting motor speed is compared with values from a calibration curve stored in a memory. The value of the input resistance of the filters under the current conditions can be determined from here.

The blow filter device according to the invention has advantages over the known solutions of the state of the art in that it automatically provides the required optimum airflow volume after connecting the head part and switching on the blower, regardless of the value of the input resistance prevailing at the blower based on the type, number, and assignment of the upstream filters, both in hood and mask operation, and for different types of masks. If the filter resistance changes during hood operation and the airflow falls below a threshold value of required volumetric flow, the user only has to switch the blow filter device off and on to have it provide the required airflow again. The device is therefore very easy and convenient to handle and of a simple and cost efficient design. As the device permanently operates in optimum conditions, the service life of the filters used increases.

In a further improvement of this invention, the electronic control system for monitoring the airflow volume is assigned a display unit for signaling if the required airflow volume exceeds or drops below predefined limits $Flown_{min}<Flow<Flow_{max}$, and if the filter resistance changes over time in hood operation mode, the electronically commutated direct current motor can be controlled after switching off and on and an associated automatic recalibration run with a changed pulse width modulation ratio read from the calibration curve that corresponds to the changed filter resistance. The display unit may include optical and/or acoustic signal elements.

According to a preferred improvement of the invention, the identification means for detecting the connected head part is a sensing and control system integrated into the air outlet port of the blow filter device and connected to the electronic control system wherein that sensing and control system communicates the different designs of hose fittings of the breathing hood or mask or of different breathing masks and transmits a respective signal for hood or mask operating mode or different mask operating modes to the electronic control system.

The sensing and control unit may include a switch that takes one switching position when the hose fitting of a breathing hood is connected for hood operating mode and another switching position when connecting a breathing mask to set the electronic control system to mask operating mode, wherein an actuating element for setting the switch to mask operating mode may be located in the hose fitting of the breathing mask and said actuating element may be of a different design corresponding to the respective type of mask, and the switch for mask operating mode may be set to different, mask-specific positions using a respective mask-specific pulse width modulation ratio stored in the electronic control system.

In another improvement of the invention, the switch for signaling the respective mask type and setting the respective pulse width modulation ratio can be a multipole switch.

An embodiment of the invention is explained in greater detail with reference to FIG. 1, the only attached figure, showing a blow filter device with an associated electronic control system that is connected to a breathing hood.

The blow filter device 1 includes a housing 2 for various filter inserts 3, 4, an electronic control system 5, a motor 6 that drives a blower 7, and a connection 8 for a connecting hose 9 to a breathing hood 10. Ambient air is aspirated by the blower 7 and flows through the filter inserts 3, 4 and via the connecting hose 9 with a fitting 11 into the breathing hood 10 where it is available to a user as purified air.

The electronic control system 5 includes an accumulator 12 for power supply, a processor 13, a memory 14, a display unit 15 with optical and acoustic signal elements 16, 17 as well as a switch 18 for switching the blow filter device 1 on and off.

As breathing masks and hoods are operated in different operating modes, the electronic control system 5 must detect, if a breathing mask or—like in the embodiment described—a breathing hood 10 is connected to the device. The air outlet port 8 on the blow filter device 1 therefore comprises an identification 25 switch 19 that is electrically connected to the electronic control system 5. Depending on its position (closed or open), the electronic control system 5 displays of the air outlet port 8 is connected to a breathing hood 10 or a breathing mask. While a breathing mask comprises an actuating element 20 (shown in 30 dashed lines in FIG. 1) in its corresponding fitting of the connecting hose for closing the switch 19, such an actuating element is absent in the hose fitting 11 for a breathing hood 10 shown here so that the switch remains in its open position when the hose fitting 11 is fitted on. Now the electronic control system 5 generates a signal that corresponds to the switch position to 5 identify the respective connected head part.

The motor in the blow filter device 1 is operated as a commutated direct current motor 6. A pulse width modulated signal is used for triggering, the pulse width modulation ratio being determined by a relation of signal on time t1 to signal off time t2. This pulse width modulation (PWM) ratio is used as a control variable and generally determines the motor speed and thus the blower speed and airflow volume.

For a blow filter device with a breathing hood, the motor speed n is inversely proportional to the air volume delivered and depends on the input resistance of the filter inserts 3, 4. If the input resistance of the filter inserts 3, 4 changes, such as by contamination or when using different filters, the motor speed and volumetric flow for the pulse width modulation ratio set change at an inverse proportion. To keep the volumetric flow constant when the input resistance changes, motor speed must be changed by changing the pulse width modulation ratio.

To supply the required optimum airflow volume of e.g. 135±7 l/min to the breathing hood at a changed input resistance using a pulse width modulated motor control system for different or changing input resistance, a table of values or calibration curve that reflects the relationship among the pulse width modulation (PWM) ratio, motor speed (n), filter resistance, and airflow volume is stored in the memory 14 of the electronic control system. The respective control variables (pulse width modulation ratios) that match different filter resistances are determined to create the calibration curve for a specific airflow volume, e.g. 135 l/min.

The device is put into service using the on/off switch 18. According to the embodiment described herein, the electronic control system 5 has received a signal that a breathing hood 10 is connected from the air outlet port 8 (blow filter device outlet) due to a specific position of the identification switch 19 after connecting the hose fitting 11 of a breathing hood 10. An automatic calibration run is performed in this case. The direct current motor 6 is triggered using a predefined pulse width modulation ratio. The resulting motor speed $n_1$ is measured by the Hall sensors 21 provided in the direct current motor 6. Then the calibration curve stored in the memory 14 can be used to determine the sum total of filter resistances from the filter inserts (gas filter 3, particle filter 4). This input resistance is used to determine the value of the pulse width modulation ratio from the calibration curve stored in the memory 14 at which the motor speed (working speed $n_2$) adjusts in such a way that the desired airflow volume (here, 135 l/min) is output. This pulse width modulation ratio is used to trigger the direct current motor 6.

The set motor speed $n_2$ is permanently measured by the Hall sensors 21 located in the direct current motor 6. In the electronic control system 5 a speed range $n_{min}<n_2<n_{max}$ for an input resistance determined is set that defines the permissible working range. If the input resistance of the filter inserts 3, 4 changes, e.g. due to contamination (high resistance) or a leak in the output section (low resistance), the motor speed n is increased or decreased accordingly. If the measured value for the motor speed $n_2$ is outside the defined working range, the electronic control unit 5 triggers an alarm as the airflow volume no longer has the desired value when the motor speed is out of working range. The table below gives exemplary working speeds and their associated working ranges at various pulse width modulation ratios.

| Pulse width modulation ratio | Speed n | $n_{min}$ | $n_{max}$ |
|---|---|---|---|
| 41 | 4300 | 3150 | 4600 |
| 55 | 5080 | 4500 | 5500 |
| 60 | 6120 | 5500 | 6700 |
| 78 | 7560 | 7150 | 8000 |

The alarm is displayed by the display unit 15 using optical signal elements 16 and/or acoustic signal elements 17. The alarm signals to the wearer of the breathing apparatus a change in conditions the wearer has to respond to by either switching the device off and back on and triggering another calibration run that sets a new motor speed by a new pulse width modulation ratio to restore the desired airflow volume, or by cleaning or replacing the filter inserts 3, 4.

The blow filter device 1 previously used with a breathing hood can also be used with a breathing mask. The identification switch 19 is actuated by the actuating element 20 when the hose fitting of a breathing mask is connected, which signals to the electronic control system 5 that the blow filter device 1 is to supply blower air to a breathing mask. Unlike a breathing hood, a breathing mask sits close to the wearer's face and is sealed against the outside atmosphere by the respiratory valve even if a negative pressure occurs inside the mask, so only air purified by the filter inserts 3, 4 reaches the wearer. In this case, the direct current motor 6 of the blow filter device 1 can be controlled with a constant pulse width modulation ratio regardless of the input resistance of the filter inserts 3, 4. The calibration described above for the hood operating mode is not required in mask operating mode.

The identification switch 19 in connection with the actuating element 20 may comprise several switching positions to detect different mask types with different input resistance values and to send a respective signal to the electronic control system 5. A predefined value for the pulse width modulation ratio that corresponds to the mask type and is stored in the memory 14 can be set depending on the type of mask connected.

Instead of the identification switch described herein, sensors for identifying the different head parts for the respective modes of the electronic control system can be provided at the blower outlet.

| List of reference symbols: | |
|---|---|
| 1 | Blow filter device |
| 2 | Housing |
| 3 | Filter insert/gas filter |
| 4 | Filter insert/particle filter |
| 5 | Electronic control system |
| 6 | Direct current motor, electronically commutated |
| 7 | Blower |
| 8 | Air outlet port (blower outlet) |
| 9 | Connecting hose |
| 10 | Head part (here: breathing hood) |
| 11 | Hose fitting |
| 12 | Accumulator |
| 13 | Processor |
| 14 | Memory |
| 15 | Display unit |
| 16 | Optical signal elements |
| 17 | Acoustic signal elements |
| 18 | On/off switch |
| 19 | Identification switch |
| 20 | Actuating element for 19 |
| 21 | Hall sensors |

The invention claimed is:

1. A blow filter device for breathing masks and hoods including a blower driven by a motor and at least one filter arranged upstream from the blower, as well as an electronic control system associated with the blower motor for adjusting a predefined airflow volume, wherein the blower motor is an electronically commutated direct current motor controlled by a pulse width modulation (PWM) ratio and equipped with speed sensors, the pulse width modulation (PWM) ratio being used as a control variable generally determining motor speed and thus blower speed and air flow volume;

wherein:

a calibration curve is created and stored in a memory of the electronic control system for a specific airflow volume based on a plurality of different filter resistances, respective corresponding pulse width modulation (PWM) ratios, and respective blower motor speeds (n);

the direct current motor is controlled in a hood operating mode using the pulse width modulation ratio read from the calibration curve associated with the blower speed (n) measured after the direct current motor is switched on, the blower speed (n) related to a filter resistance; and the pulse width modulation (PWM) ratio used in a mask operating mode comprises a constant pulse width modulation (PWM) ratio specific to a type of mask regardless of the respective filter resistance;

and further including a sensing and control system, a portion thereof being integrated into an air outlet port of the blow filter device and connected to the electronic control system, said sensing and control system including an identification switch, a first hose connection for attaching breathing masks to the air outlet port, the first hose connection is provided with an actuator for the identification switch, and a second hose connection for attaching breathing hoods to the air outlet port, the second hose connection is devoid of an actuator, the sensing and control system generating a signal corresponding to an actuation state of the identification switch upon completion of the first or second hose connection to the air outlet port.

2. The blow filter device according to claim 1, wherein the electronic control system monitors the airflow volume and comprises a display unit for indicating if a predefined speed range ($n_{min} \leqq n \leqq n_{max}$) is exceeded or not reached and if a sensed filter resistance changes over time in hood operating mode, the direct current motor can be controlled with a new pulse width modulation ratio read from the calibration curve that corresponds to the sensed change in filter resistance after switching the device off and on and an associated automatic calibration run.

3. The blow filter device according to claim 1 or 2, wherein the speed sensors comprise Hall sensors provided in the direct current motor for measuring the motor speed.

4. The blow filter device according to claim 2, wherein the display unit includes optical and/or acoustic signal elements.

5. The blow filter device according to claim 1, wherein the identification switch has one switching position when the second hose connection of a breathing hood is connected for hood operating mode, and another switching position when the first hose connection of a breathing mask is connected to set the electronic control system to mask operating mode.

6. The blow filter device according to claim 5, wherein the first hose connection comprises a hose fitting of the breathing mask and the actuator is provided in the hose fitting of the breathing mask.

7. The blow filter device according to claim 6, wherein the actuator has different designs according to mask type and that the identification switch can be set to different positions specific to the mask type for setting a mask type-specific pulse width modulation ratio stored in the electronic control system.

8. The blow filter device according to claim 7, wherein the identification switch is a multipole switch and signals the respective type of mask and sets the respective pulse width modulation ratio.

9. The blow filter device according to claim 5, wherein in the hood operating mode the identification switch is in an open position and in the mask operating mode the identification switch is in a closed position.

10. The blow filter device according to claim 1, wherein the direct current motor, the electronic control system and the display unit are connected to an accumulator via an on/off switch.

11. The blow filter device as in claim 1 wherein the identification switch has a plurality of switching positions to detect different types of equipment.

12. The blow filter device as in claim 1 wherein the identification switch in connection with the actuator comprises several switching positions to detect different mask types with different input resistance values.

* * * * *